US006244770B1

(12) United States Patent
Holloway

(10) Patent No.: US 6,244,770 B1
(45) Date of Patent: Jun. 12, 2001

(54) DISPENSER WITH POMADE HOLDING FLEXIBLE TAB

(75) Inventor: Thomas F. Holloway, Southbury, CT (US)

(73) Assignee: Crown Cork & Seal Technologies, Corporation, Alsip, IL (US)

( * ) Notice: Subject to any disclaimer, the term of this patent is extended or adjusted under 35 U.S.C. 154(b) by 0 days.

(21) Appl. No.: 09/569,669

(22) Filed: May 12, 2000

(51) Int. Cl.[7] ..... B43K 21/08
(52) U.S. Cl. ..... 401/78; 401/77; 401/75
(58) Field of Search ..... 401/78, 77, 75, 401/68, 55

(56) References Cited

U.S. PATENT DOCUMENTS 2,797,803 * 7/1957 Hopgood ..... 401/78
3,539,266 * 11/1970 Hultgren ..... 401/78
5,871,295 * 2/1999 Bouix ..... 401/78

* cited by examiner

*Primary Examiner*—David J. Walczak
(74) *Attorney, Agent, or Firm*—St. Onge Steward JOhnston & Reens LLC

(57) ABSTRACT

An elevator cup for receiving and supporting a cosmetic pomade in a cosmetic dispenser, comprising a hollow tubular body having a side wall, a closed bottom end, and an open top end for receiving a pomade; and one or more flexible tabs for positively engaging said pomade extending from an inner surface of the side wall. The flexible tabs are movable between a first position, wherein said flexible tab forms an acute angle with the side wall opening toward said bottom end, and a second position, wherein said flexible tab is substantially flush with said inner surface of the side wall. The flexible tab is deflectable from the first position to the second position upon receipt of a pomade and positively engages said pomade by returning to said first position by a spring force created in the flexible tab by the deflection from the first to the second position.

12 Claims, 3 Drawing Sheets

DISPENSER WITH POMADE HOLDING FLEXIBLE TAB

FIELD OF THE INVENTION

The present invention relates to the field of lipstick and cosmetic dispensers having a propelling and retracting mechanism for a cosmetic pomade contained within the dispenser, and more particularly, to the elevator cups within such dispensers.

BACKGROUND OF THE INVENTION

Traditionally, a lipstick pomade is positioned and secured within a dispenser by an elevator cup. The elevator cup provides a stable mounting surface for the pomade and permits the pomade to be raised and lowered within the dispenser for use and storage by the user. Generally, a friction fit between the pomade and an inner wall of the elevator cup is sufficient to hold the pomade securely within the elevator cup.

However, some pomades, particularly silicone-filled pomades with significant quantities of volatile components, do not seat securely in the elevator cup after extended periods of use. The trend in the cosmetics product market is towards "non-transferable" lipstick products. The new products are heavy, silicone filled lipsticks that do not transfer from the wearers lips, or leave residue, such as on coffee cups or clothing. These lipstick formulations have a significant quantity of volatile components in their formulations. As such, they must be kept enclosed in an airtight container when not in use or else they quickly dry out and shrink. Even when properly stored, a significant level of shrinkage may occur due to the volatile nature of the silicone compositions. Thus, the traditional friction fit used to secure the pomades within the elevator cup is inadequate for use with pomades containing the new compositions because when the pomades shrink over time, the friction fit is diminished and the pomade can become dislodged, potentially rendering the lipstick product useless.

Many current designs of elevator cups include ribs and spikes extending from locations within the elevator cup to increase the surface area in contact with the pomade, to better secure the pomade in the elevator cup. While each have differing degrees of effectiveness, most designs generally include ribs or spikes that extend into the pomade to maintain contact as the pomade shrinks away from the inner walls of the elevator cup. However, the present designs do not provide the necessary amount of friction to ensure the pomade stays in place in the elevator cup as it shrinks.

U.S. Pat. No. 5,560,727 to Vaupel attempts to address the problem by providing spring elements that are pressed into the pomade to create rear-engaging lugs through a cam action between cams located on the spring elements and a slotted tube located within the dispenser. A similar design is disclosed in U.S. Pat. No. 5,865,550 to Bouix wherein a tab is pressed into the pomade through a similar cam action between a cam surface located on the tab and a cam surface located on an inner sleeve. In Bouix, the tab mechanically locks into place upon penetration of the pomade through an interaction between the tab and the cup wall. Both of the above tabs require specialized designs and interactions between various components of the dispensers for proper penetration and engagement of the of the tabs into pomade, though, which complicates manufacturing and assembly of the dispensers.

What is desired, therefore, is an elevator cup with a means for securely holding pomades within the elevator cup upon shrinkage of the pomade, desirably, the means for securing the pomade is simple in design and operation.

SUMMARY OF THE INVENTION

Accordingly, It is an object of the invention to provide a cosmetic dispenser with an elevator cup that includes a means for securing a pomade within the elevator cup upon shrinkage of the pomade.

Another object of the invention is to provide an elevator cup with tabs for securing a pomade that is simple in design and assembly.

These objects, and other objects which shall become apparent hereafter, are accomplished by a elevator cup for use in a cosmetic dispenser in accordance with one embodiment of the invention, comprising a hollow tubular body having a side wall, a closed bottom end, an open top end for receiving a pomade, and a plurality of flexible tabs extending from an inner surface of the side wall to engage the pomade. The flexible tabs are deflectable between a first position, extending radially inward from the sidewall and a second position substantially flush with the sidewall. The tabs are deflectable from the first position to the second position by the receipt of a pomade into the elevator cup. The deflection of the tabs creates a spring force within the tabs causing the tabs to penetrate and engage the pomade as the tabs return to the first position. The invention further relates to a cosmetic dispenser incorporating such an elevator cup.

Other objects, aspects and features of the invention in addition to those mentioned above will be pointed out in or will be understood from the following detailed description in conjunction with the drawings.

DETAILED DESCRIPTION OF THE INVENTION

Figure 1:
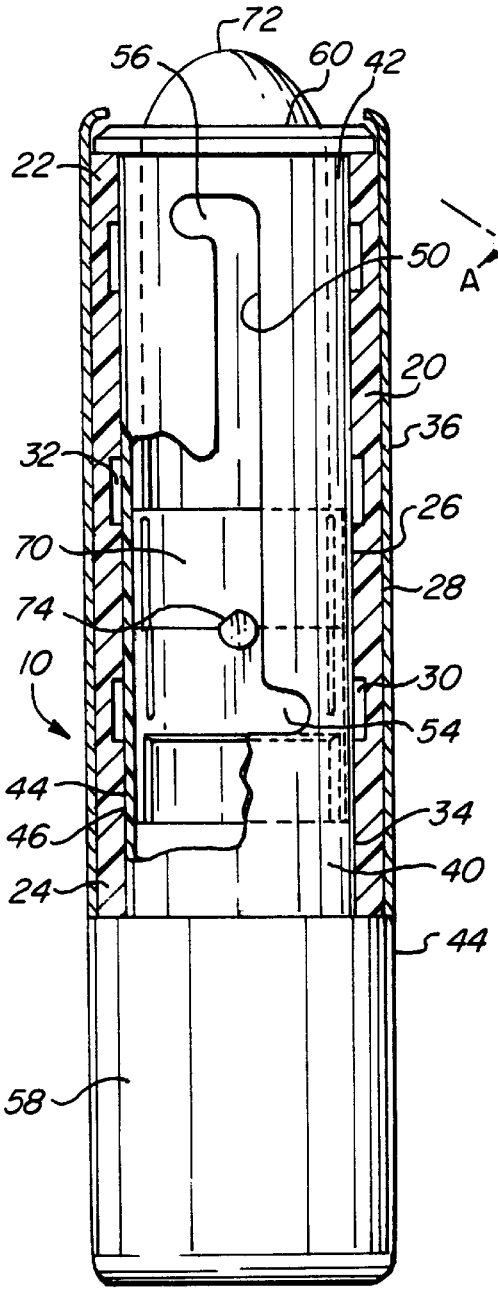
FIG. 1 is a partial cutaway view of a lipstick dispenser in accordance with one embodiment of the invention.

Referring now to FIGS. 1–12, where like elements are identified by like numbers in the drawings, a cosmetic dispenser in accordance with an embodiment of the invention is shown generally at 10. The dispenser 10 comprises a cam sleeve 20, an innerbody 40, and an elevator cup 70.

Cam sleeve 20 is rigid and tubular and has an upper end 22 and a lower end 24. Cam sleeve 20 has an inner wall 26 and an outer wall 28. At least one and preferably two internal helical threads 30 and 32 are formed on the inner wall 26. Helical threads 30 and 32 are located 180 degrees apart and extend along a substantial length of the inner wall 26 of the cam sleeve 20. Cam sleeve 20 may have an unthreaded lower inner wall segment 34 at its lower end 24. An ornamental outer shell 36, such as a metal tube, may be fitted over the outer wall 28 of the cam sleeve for decoration.

Innerbody 40 is also tubular and has an upper end 42 and a lower end 44. Innerbody 40 has an inner wall 46 and an outer wall 48. Innerbody 40 is fitted into the cam sleeve 20 and has at least one and preferably two longitudinal tracks 50 (only one shown) which extend along the axial length of the innerbody 40 and which extend through the walls 46 and 48 of the innerbody 40 along a substantial length of the innerbody 40. Preferably, one of the longitudinal tracks (not shown) extends to the upper end 42 of the innerbody 40 so that it is open at its upper end to facilitate assembly of the dispenser 10. The other longitudinal track 50 preferably does not so extend so that it is closed at its upper end.

The longitudinal tracks 50 may have at their lower ends lower lateral track segments 54 which preferably extend perpendicularly from the longitudinal tracks 50. The longitudinal tracks 50 preferably also have at their upper ends upper lateral track segments 56 which preferably also extend perpendicularly from the longitudinal tracks 50. Preferably, the upper lateral tracks 56 extend in the opposite direction from the lower lateral tracks 54. The upper and lower lateral track segments 54 and 56, respectively, assist the elevator cup 70 to be locked in an extended position for application of a cosmetic or retracted position for storage and transport.

The innerbody 40 is interlocked with the cam sleeve 20 so that rotation or application of a swivel torque to the cam sleeve 20 relative to innerbody 40 can be accomplished by gripping an extended cylindrical portion knob 58 on innerbody 40 with one hand and cam sleeve 20 with the other hand to raise or lower elevator cup 70 as set forth hereafter. The cam sleeve 20 and innerbody 40 are preferably secured together by a retaining lip 60 on the upper end 42 of innerbody 40 that retains the upper end 22 of cam sleeve 20 in place on innerbody 40. The knob 58 of innerbody 40 has a larger diameter than the lower end 24 of cam sleeve 20 and thereby holds the cam sleeve lower end 24 in place. Alternative retaining means might also comprise an interfitting combination of a rib and channel for receiving the rib or other suitable means for rotatably connecting innerbody 40 and cam sleeve 20.

The elevator cup 70 is generally cylindrical and holds and supports the cosmetic pomade 72. The cup 70 is described in more detail below. The cup 70 is fitted into innerbody 40. Cup 70 has at least one and preferably two cam follower lugs 74 for seating in and following in the longitudinal tracks 50 of the innerbody 40 and the helical threads 30 and 32 of the cam sleeve 20. The lugs 74 are located 180 degrees apart and have a sufficient length to extend through the longitudinal tracks 50 to engage the helical threads 30 and 32. The lugs may be formed with a flat section 76 for increasing the frictional drag between the lugs 74 and helical threads 30 and 32 by increasing the surface area in contact between the lugs 74 and helical threads 30 and 32 of the cam sleeve 20. This provides the desired sense or feel of quality to the customer user. Additionally, the additional friction drag reduces undesirable pomade back-off that can occur during use of the dispenser 10. Such back-off often occurs when pressure is applied to the pomade 72 during use.

The cup 70 may have an upper segment 78 and a lower skirt 80. Located below the lugs 74 may be reduced radius zones 82 in skirt 80 to facilitate the inclusion of various locking and securing mechanisms. In the reduced radius zones 80 the cup 70 has a lesser radius than in the upper segment 78. The reduced radius zones 80 are preferably rectangular flat areas located below lugs 74. The cup 70 may further include stabilizer ribs 84 running longitudinally along an outer surface of the elevator cup 70 to improve the action of the dispenser 10.

Cup 70 is movable within the dispenser 10 in an axial path in a conventional manner by relative rotation of the innerbody 40 and cam sleeve 20 by virtue of the lugs 74 seating in the helical threads 30 and 32 of cam sleeve 20 and the longitudinal tracks 50 of innerbody 40. The relative rotation of the cam sleeve 20 and innerbody 40 causes the cup 70 to move axially to propel the elevator cup 70 to an extended position, and relative rotation in the opposite direction causes the elevator cup 70 to retract to a retracted position. In the preferred embodiment, the helical threads 30 and 32 are right hand threads in the cam sleeve 20 and have a thread pitch of about 30 degrees so that each makes one complete revolution as the cup 70 traverses the length of the dispenser 10. This is desirable as only a single turn is needed to fully activate the dispenser 10.

Typically, a cap (not shown) will also be provided with the dispenser 10. Such a cap has a lower end suited for fitting over the cam sleeve 20 and its decorative shell 36, and can be frictionally mounted on the lower end 44 of the innerbody 40. For decorative enhancement, the cap and the lower end 44 of innerbody 40 may also have decorative shells fitted over them. These decorative shells may be affixed to their respective underlying structural components by gluing and/or by forming their ends to clip onto the ends of the cam sleeve 20, cap and innerbody lower end 44.

It is to be appreciated that while the above description refers to a specific raising and lowering mechanism, there are numerous mechanisms and means for accomplishing movement of the elevator cup 70 within the cosmetic dispenser.

Figure 2:
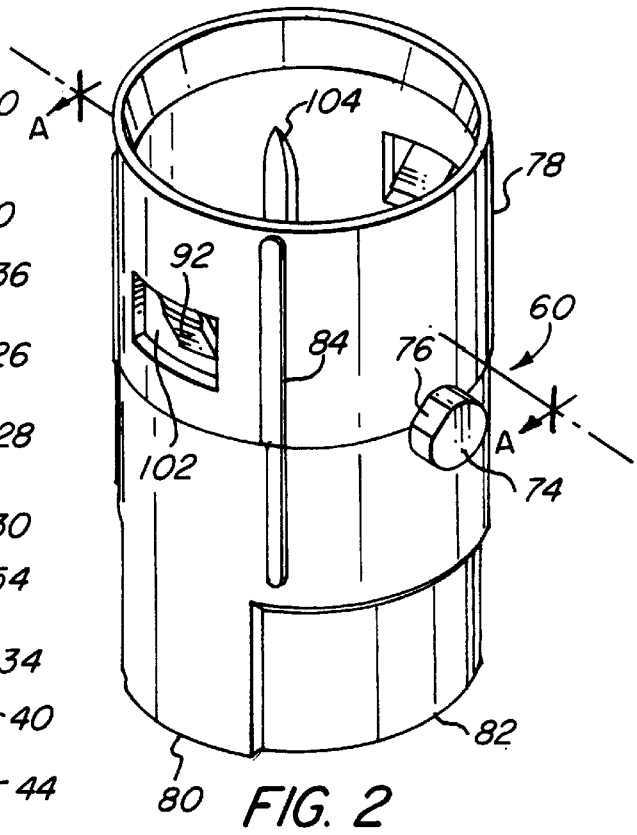
FIG. 2 is a perspective view of a elevator cup in accordance with one embodiment of the invention.
Figure 3:
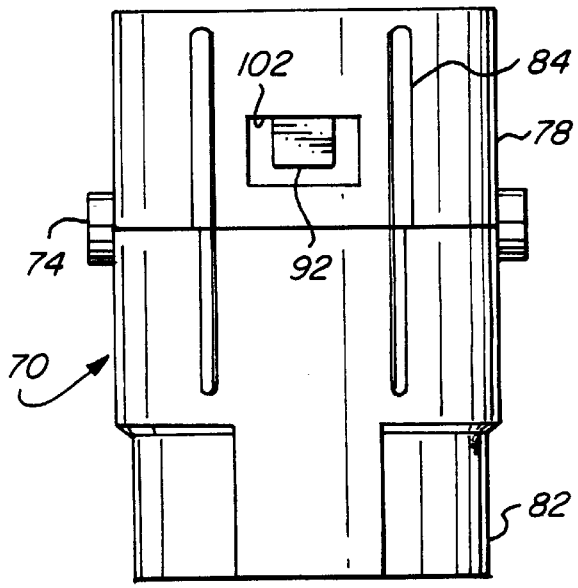
FIG. 3 is a front view of the elevator cup of FIG. 2.
Figure 6:
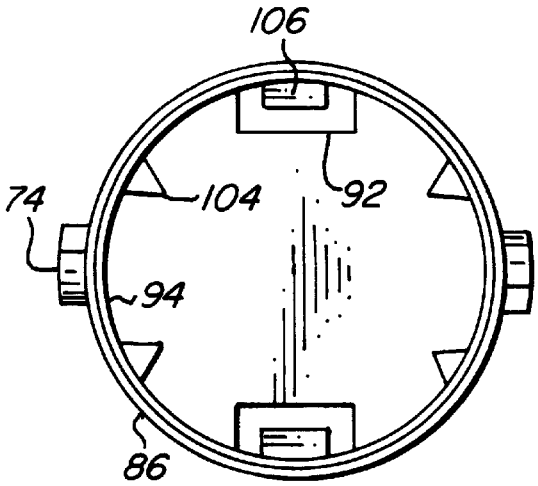
FIG. 6 is a top view of an elevator cup in accordance with one embodiment of the invention.
Figure 7:
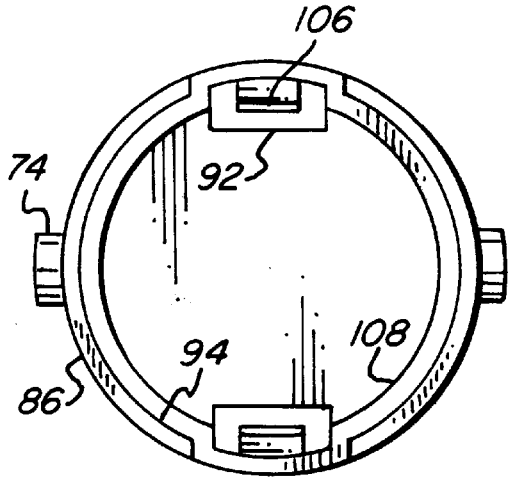
FIG. 7 is a top view of an elevator cup in accordance with another embodiment of the invention.
Figure 4:
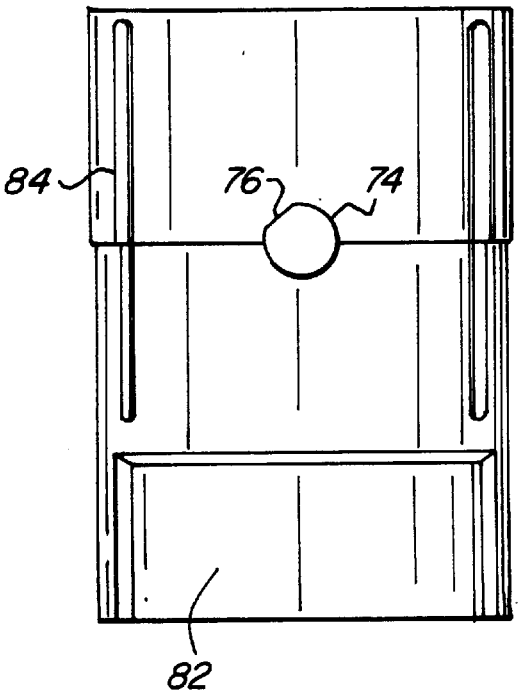
FIG. 4 is side view of the elevator cup of FIG. 2.
Figure 5:
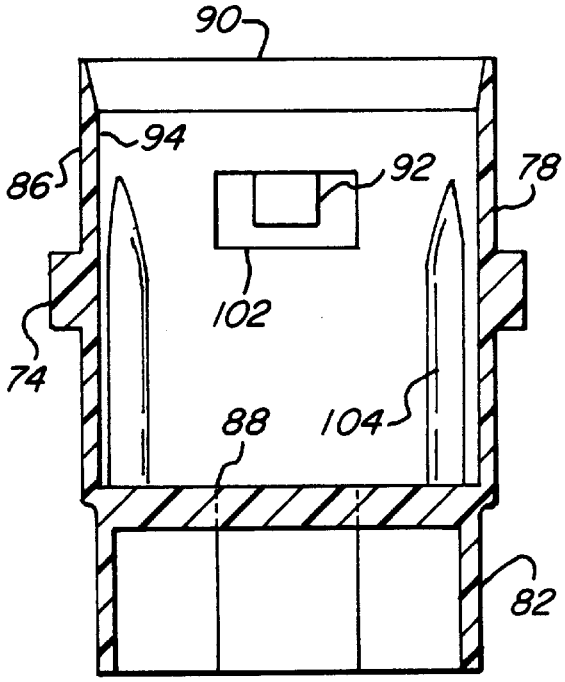
FIG. 5 is a cross-sectional view of the elevator cup of FIG. 2 along the line A—A.

The elevator cup 70 is shown in greater detail in FIGS. 2–10. The elevator cup 70 comprises a hollow, generally tubular body having a side wall 86, a closed bottom end 88 and an open top end 90 for receiving a cosmetic pomade 72. The cup 70 is preferably manufactured out of a plastic, such as acetal, but it is understood that any suitable material may be used. The cup 70 includes one or more flexible tabs 92 extending from an inner surface 94 of the side wall 86 that penetrate and positively engage the pomade 72. The one or more tabs 92 may be of any design suitable for penetrating and engaging the pomade 72 and readily amenable to the necessary manufacturing and molding processes. For example, the tab 92 may be rectangular in shape and solid as shown in FIGS. 2, 3, and 5, or the tab 92 may include an opening 106 formed therein as shown in FIGS. 6 and 7.

In the preferred embodiment, as shown in the Figures, there are a plurality of tabs 92 which extend downwardly and radially inwardly from the sidewall 86. The flexible tabs 92 are deflectable between a first position 98 and a second position 100. When in the first position 98, the tab 92 forms an acute angle with the inner surface 94 of the side wall 86 that opens toward the bottom end 88. The first position 98 is the natural position of the tabs 92 set during manufacture of the cup 70. In the second position 100, the tabs 92 are deflected into corresponding receptacles 102 that receive the tabs 92 such that the tabs 92 become flush with the inner surface 94 of the side wall 86. The receptacles 102 may be recesses in the inner surface 94 of the side wall 86 or apertures in the side wall 86.

Figure 8:
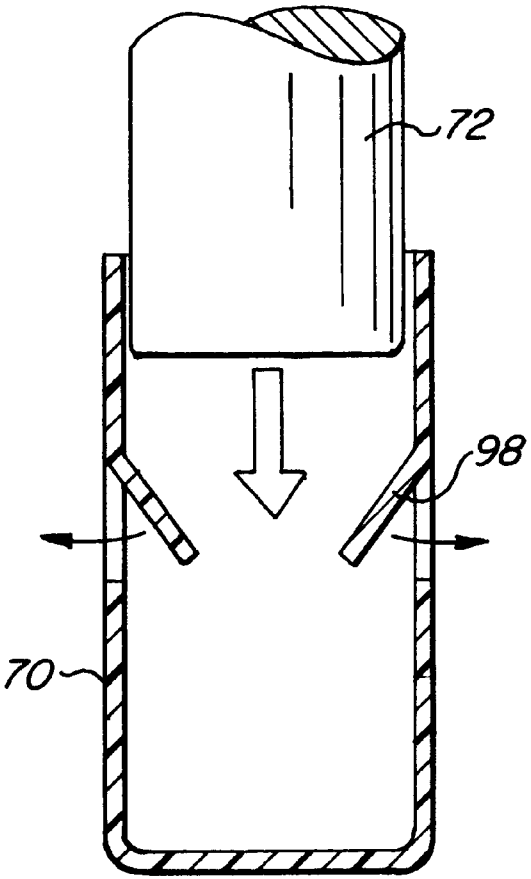
FIG. 8 is a cross sectional view of an elevator cup receiving a pomade in accordance with an embodiment of the invention.
Figure 9:
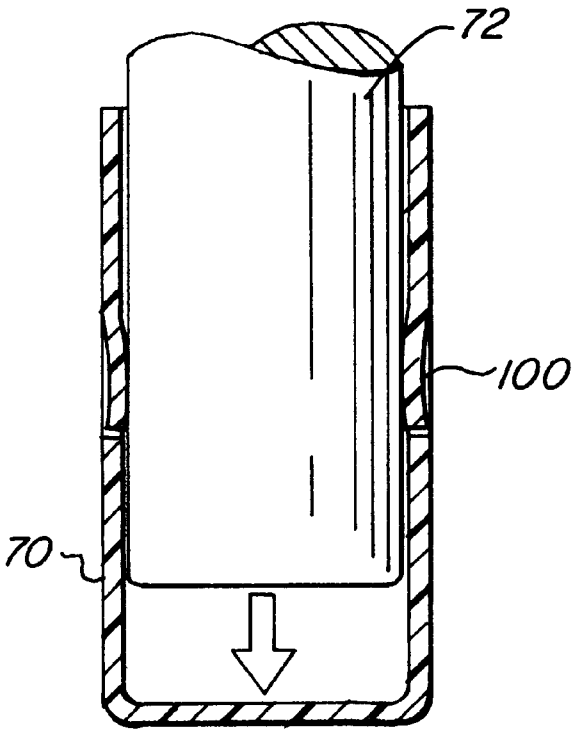
FIG. 9 is a cross sectional view of an elevator cup in receipt of a pomade prior to engagement of the tabs in accordance with an embodiment of the invention.
Figure 10:
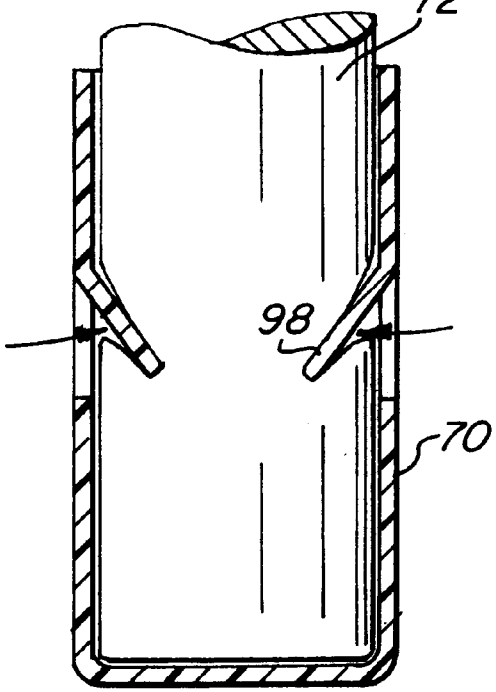
FIG. 10 is a cross sectional view of an elevator cup in receipt of a pomade with tabs engaged in accordance with an embodiment of the invention.

In practice, the tabs 92 are deflected from the first position 98 to the second position 100 by the pomade 72 when the pomade 72 is loaded into the elevator cup 70, as shown in FIGS. 8–10. The deflection of the tabs 92 creates a spring force within the tabs 92 that urges the tabs to return to the first position 98. Thus, once the pomade 72 has been loaded into the elevator cup 70, the spring force created within the tabs 92 causes the tabs 92 to slowly penetrate and engage the pomade 72 upon returning to the first position 98. Preferably, the design and choice of materials of the tabs 92 is such that the tabs 92 are readily deflectable by the pomade 72 so as to not score the sides of the pomade 72 upon loading. However, the tabs 92 must be resilient enough to penetrate the pomade 72 when returning to the first position 98.

The cup 70 may further include any number of a plurality of ribs, barbs, or other means known in the art that extend from or pass through the various components of the elevator cup 70 to contact or penetrate the pomade 72 in order to increase the surface area in contact with the pomade 72 and thus further increase the security of the pomade 72 within the elevator cup 70. For example, as shown in FIGS. 2, 5, and 6, the cup 72 may include longitudinal ribs 104 extending axially along the inner surface 94 of the side wall 86 for engaging a pomade 72. As another example, the elevator cup 70 may include circular ribs 108 extending radially inward from the circumference of the inner surface 94 to further engage a pomade 72 as shown in FIG. 7.

It is to be appreciated that the foregoing is illustrative and not limiting of the invention, and that various changes and modifications to the preferred embodiments described above will be apparent to those skilled in the art. Such changes and modifications can be made without departing from the spirit and scope of the present invention, and it is therefore intended that such changes and modifications be covered by the following claims.

What is claimed is:

1. An elevator cup for receiving and supporting a cosmetic pomade in a cosmetic dispenser, comprising:

a hollow tubular body having a side wall, a closed bottom end, and an open top end for receiving the pomade;

a cosmetic pomade located in said hollow tubular body; and, one or more flexible tabs positively engaging said pomade, said tabs extending downwardly and radially inwardly from an inner surface of said side wall and being movable between a first position, wherein said flexible tabs form an angle relative to said side wall, and a second position, wherein said flexible tabs are substantially flush with said inner surface of said side wall;

said flexible tabs being deflectable from said first position to said second position upon receipt of said pomade in said tubular body wherein said tabs positively engage said pomade by returning to said first position by a spring force created in said flexible tabs by the deflection from the first to the second position.

2. The elevator cup of claim 1, wherein each said flexible tab forms an acute angle relative to said side wall.

3. The elevator cup of claim 1, wherein each of said flexible tabs has a receptacle in said side wall proximal thereto for receiving said flexible tab in said second position.

4. The elevator cup of claim 3, wherein said receptacle comprises an aperture in said side wall.

5. The elevator cup of claim 3, wherein said receptacle comprises a recess in said inner surface.

6. The elevator cup of claim 1 further comprising at least one internal rib for engaging said pomade extending axially along an inner surface of said side wall and projecting radially inward from said inner surface of said side wall.

7. A cosmetic dispenser, comprising:

a tubular cam sleeve having upper and lower ends and inner and outer walls and having at least one internal helical thread extending along a substantial length of the inner wall of said cam sleeve;

a cosmetic pomade located in said hollow tubular body;

a tubular innerbody having upper and lower ends, said innerbody being fitted into said tubular cam sleeve and being provided with a longitudinal track extending through the wall of said innerbody along a substantial length of said innerbody; and, a generally cylindrical elevator cup for receiving and supporting said cosmetic pomade, fitted into said innerbody and having at least one cam follower lug extending through said longitudinal track to engage said at least one helical thread, said elevator cup being movable in an axial path by relative rotation of said innerbody and cam sleeve, said elevator cup having one or more flexible tabs extending from an inner surface of a side wall of said elevator cup for positively engaging said pomade, said plurality of tabs being movable between a first position, wherein each of said plurality of flexible tabs form an acute angle relative to said side wall opening toward a bottem end, and a second position, wherein each of said flexible tabs is positioned substantially flush with said inner surface of said side wall, each of said flexible tabs being deflectable from said first position to said second position upon receipt of said pomade and positively engaging said pomade by returning to said first position by a spring force created within each of said flexible tabs by the deflection from said first to said second position.

8. The cosmetic disperser of claim 7, wherein each of said flexible tabs has a receptacle in said side wall proximal thereto for receiving said flexible tab in said second position.

9. The cosmetic dispenser of claim 8, wherein said receptacle comprises an aperture in said side wall.

10. The cosmetic dispenser of claim 8, wherein said receptacle comprises a recess in said inner surface.

11. The cosmetic dispenser of claim 7 wherein said elevator cup further comprises at least one internal rib for engaging said pomade extending axially along an inner surface of said side walls and projecting radially inward from said inner wall.

12. The cosmetic dispenser of claim 7 wherein said elevator cup further comprises at least one stabilizer rib extending axially along an outer surface of said side walls toward said bottom end and projecting radially outward from said outer wall.

* * * * *